US011511540B2

(12) United States Patent
Nakano et al.

(10) Patent No.: US 11,511,540 B2
(45) Date of Patent: Nov. 29, 2022

(54) LIQUID DISCHARGING APPARATUS

(71) Applicant: BROTHER KOGYO KABUSHIKI KAISHA, Nagoya (JP)

(72) Inventors: Yasuhiro Nakano, Nagoya (JP); Toshiyuki Yamane, Chiryu (JP); Toshio Sugiura, Anjo (JP); Jiro Yamamoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 74 days.

(21) Appl. No.: 17/213,962

(22) Filed: Mar. 26, 2021

(65) Prior Publication Data

US 2021/0300034 A1 Sep. 30, 2021

(30) Foreign Application Priority Data

Mar. 30, 2020 (JP) ..... JP2020-059465

(51) Int. Cl.
*B41J 2/165* (2006.01)
*B41J 2/045* (2006.01)

(52) U.S. Cl.
CPC ..... *B41J 2/04573* (2013.01); *B41J 2/1652* (2013.01)

(58) Field of Classification Search
CPC ..... B41J 2/1652; B41J 2/16508
See application file for complete search history.

(56) References Cited

U.S. PATENT DOCUMENTS 10,654,274 B2 * 5/2020 Murayama ..... B41J 2/16526
2010/0231630 A1 9/2010 Okazaki
2020/0307177 A1 * 10/2020 Nakano ..... B41J 2/16508

FOREIGN PATENT DOCUMENTS

JP 2003-300313 A 10/2003
JP 2010-214726 A 9/2010
JP 2010-214727 A 9/2010

* cited by examiner

*Primary Examiner* — Sharon Polk
(74) *Attorney, Agent, or Firm* — Baker Botts L.L.P.

(57) ABSTRACT

A liquid discharging apparatus includes a liquid discharging head having nozzles, a tank which stores liquid, and a controller. The controller causes the liquid discharging head to perform a discharging operation for discharging the liquid from the nozzles based on a discharging data. The discharging data includes unit discharging data indicating whether the liquid is to be discharged from the nozzles within a predetermined time period. In the discharging operation, a) if a discharge amount based on the unit discharging data is less than a threshold value, the liquid discharging head performs a first discharging operation during the predetermined time period, and b) if the discharge amount based on the unit discharging data is equal to or more than the threshold value, the liquid discharging head performs a second discharging operation during another time period longer than the predetermined time period.

9 Claims, 9 Drawing Sheets

LIQUID DISCHARGING APPARATUS

CROSS REFERENCE TO RELATED APPLICATION

The present application claims priority from Japanese Patent Application No. 2020-059465, filed on Mar. 30, 2020, the disclosure of which is incorporated herein by reference in its entirety.

BACKGROUND

Field of the Invention

The present invention relates to a liquid discharging apparatus discharging liquid from nozzles.

Description of the Related Art

As an example of the liquid discharging apparatus discharging liquid from the nozzles, there is known an ink jet printer which performs recording by discharging ink from nozzles. Such an ink jet printer forms an image by discharging the ink while moving the discharging head reciprocatingly. During the recording of the image, if such a condition is satisfied as a print duty ratio being equal to or larger than a threshold value or the like, then a duty restriction function is executed to render a waiting time by temporarily stopping the discharging head outside the recording area. By virtue of this, it is possible to prevent a so-called under refilling that is, to prevent the ink from insufficient supply to the discharging head.

SUMMARY

In the abovementioned ink jet printer, however, if the above threshold value is determined uniformly in any utilizing environment to prevent the under refilling, then the threshold value is inevitably a small one. On the other hand, the smaller the threshold value, the higher the frequency of executing the duty restriction function, thereby resulting in decrease of the recording speed.

An object of the present teaching is to provide a liquid discharging apparatus capable of shortening the time needed to discharge liquid to a medium as much as possible while sufficiently supplying the liquid to the liquid discharging head.

According to a first aspect of the present teaching, there is provided a liquid discharging apparatus including:

a liquid discharging head having a plurality of nozzles;

a tank configured to store liquid to be supplied to the liquid discharging head; and a controller, wherein the controller is configured to cause the liquid discharging head to perform a discharging operation for discharging the liquid from the nozzles base on a discharging data indicating whether the liquid is to be discharged from the nozzles, the discharging data including unit discharging data indicating whether the liquid is to be discharged from the nozzles within a predetermined time period, wherein in the discharging operation, a) under a condition that a discharge amount based on the unit discharging data is less than a threshold value, the controller is configured to cause the liquid discharging head to perform a first discharging operation to discharge the liquid from the nozzles during the predetermined time period based on the unit discharging data, and b) under a condition that the discharge amount based on the unit discharging data is equal to or more than the threshold value, the controller is configured to cause the liquid discharging head to perform a second discharging operation to discharge the liquid from the nozzles during another time period longer than the predetermined time period based on the unit discharging data, and wherein under a condition that the controller receives a signal for changing the threshold value, the controller is configured to lower the threshold value according to the discharge amount during the predetermined time period, which is included in a discharging period before the controller receives the signal.

According to a second aspect of the present teaching, there is provided a liquid discharging apparatus including:

a liquid discharging head having a plurality of nozzles;

a tank configured to store liquid to be supplied to the liquid discharging head; and a controller, wherein the controller is configured to cause the liquid discharging head to perform a discharging operation for discharging the liquid from the nozzles based on a discharging data indicating whether the liquid is to be discharged from the nozzles, the discharging data including unit discharging data indicating whether the liquid is to be discharged from the nozzles within a predetermined time period, wherein in the discharging operation, under a condition that a threshold value for a discharge amount based on the unit discharging data is not yet set, the controller is configured to cause the liquid discharging head to perform a first discharging operation to discharge the liquid from the nozzles based on the unit discharging data, regardless of the discharge amount based on the unit discharging data, under a condition that the controller receives a signal for setting the threshold value, the controller is configured to set the threshold value based on the discharge amount during the predetermined time period, which is included in the discharging period before the controller receives the signal, and in the discharging operation thereafter, a) under a condition that the discharge amount based on the unit discharging data is less than the threshold value, the controller is configured to cause the liquid discharging head to perform the first discharging operation, and b) under a condition that the discharge amount based on the unit discharging data is equal to or more than the threshold value, the controller is configured to cause the liquid discharging head to perform a second discharging operation to discharge the liquid from the nozzles during another time period longer than the predetermined time period based on the unit discharging data.

According to the present teaching, under the condition that the discharge amount is less than the threshold value on the basis of the unit discharging data, the first discharging operation is carried out, whereas under the condition that the discharge amount is equal to or more than the threshold value on the basis of the unit discharging data, the second discharging operation is carried out. Therefore, it is possible to lessen the likelihood of insufficient supply of the liquid to the liquid discharging head. Then, if the signal is received for changing the threshold value, then the threshold value is lessened according to the discharge amount over the predetermined time period included in the discharging period before the signal is received. Alternatively, with the threshold value being not yet set, if the signal is received for setting the threshold value, then the threshold value is set according to the discharge amount over the predetermined time period included in the discharging period before the signal is received. That is, before the signal for setting the threshold value or the signal for changing the threshold value is received, because the threshold value is not yet set or the threshold value is set at a larger value, the discharge amount is not lessened more than necessary per unit time. Then, if the above signal is inputted because insufficient supply of the liquid occurs in reality, then the threshold value is set or lessened according to the discharge amount over the predetermined time period included in the discharging period before the signal is received. As a result, it is possible to lessen the likelihood of the insufficient supply of the liquid.

DESCRIPTION OF THE EMBODIMENT

An embodiment of the present teaching will be explained below.

<Overall Configuration of a Printer>

Figure 1:
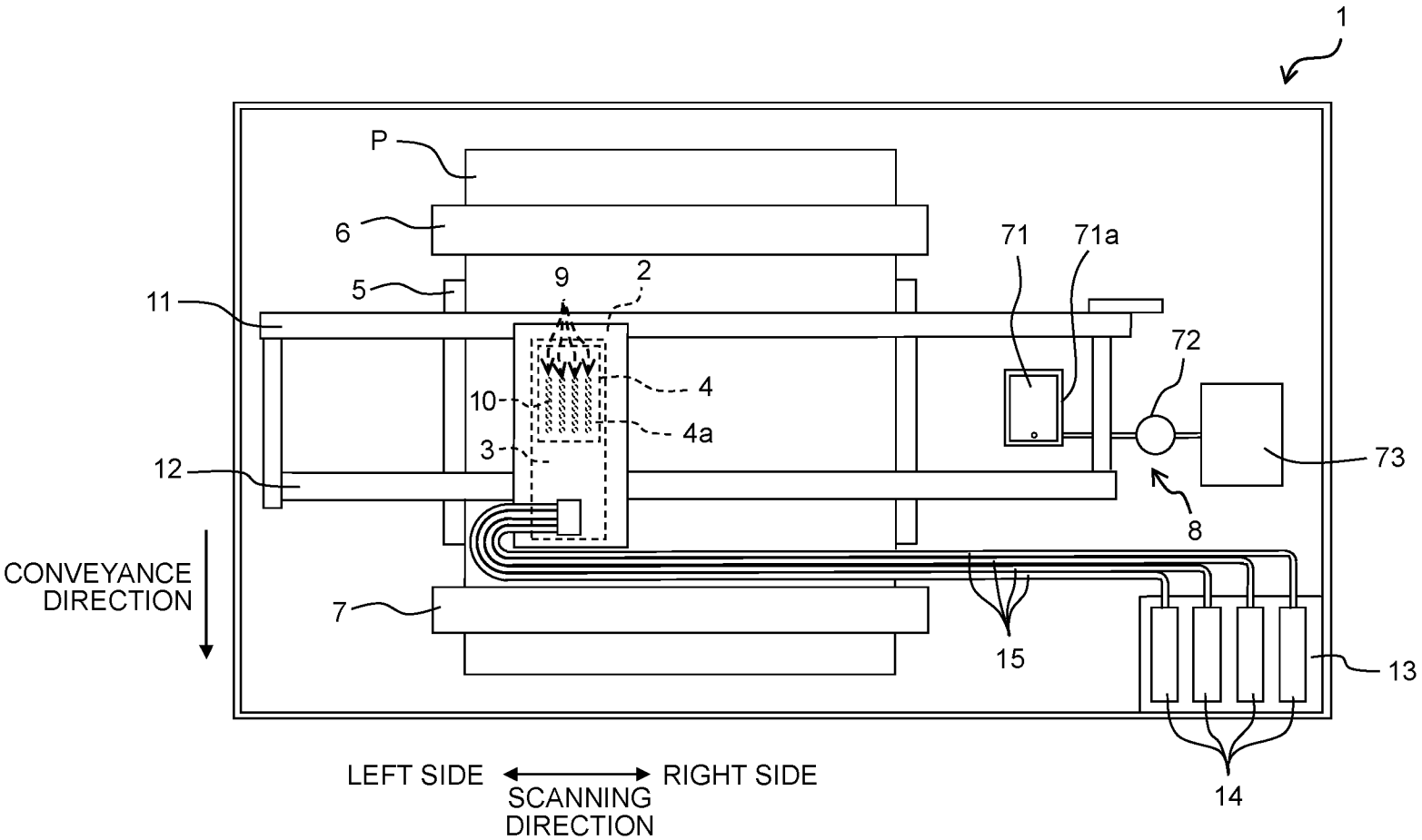
FIG. 1 shows a schematic configuration of a printer according to an embodiment of the present teaching.

As depicted in FIG. 1, a printer 1 according to the embodiment includes a carriage 2, a sub tank 3, an ink jet head 4, a platen 5, conveyance rollers 6 and 7, a maintenance unit 8, and the like.

The carriage 2 is supported on two guide rails 11 and 12 extending in a horizontal scanning direction. The carriage 2 is connected to a carriage motor 86 depicted in FIG. 2 via a belt (not depicted) or the like. When driven by the carriage motor 86, the carriage 2 moves in the scanning direction along the guide rails 11 and 12. Note that as depicted in FIG. 1, the following explanation will be made under the definition of the right side and the left side according to the scanning direction.

The sub tank 3 is mounted on the carriage 2. In this context, the printer 1 includes a cartridge holder 13, while four ink cartridges 14 are installed in the cartridge holder 13 in a removable manner. The four ink cartridges 14 align in the scanning direction to retain inks of black, yellow, cyan and magenta respectively in the alignment order from the ink cartridge 14 arranged at the right end in the scanning direction. The sub tank 3 is connected with the four ink cartridges 14 installed in the cartridge holder 13 via four tubes 15. By virtue of this, the abovementioned inks of the four colors are supplied to the sub tank 3 from the four ink cartridges 14.

The ink jet head 4 is mounted on the carriage 2 and connected to the lower end of the sub tank 3. The four color inks are supplied from the sub tank 3 to the ink jet head 4. Further, the ink jet head 4 has a nozzle surface 4*a* as the lower surface where a plurality of nozzles 10 are formed. The ink jet head 4 discharges the inks from the plurality of nozzles 10. To be explained in more detail, the plurality of nozzles 10 form four nozzle rows 9 on the nozzle surface 4*a* arranged in the scanning direction. Each nozzle row is formed from a plurality of nozzles 10 aligned in a horizontal conveyance direction orthogonal to the scanning direction. The plurality of nozzles 10 discharge the inks of black, yellow, cyan and magenta in the order from the nozzles 10 forming the nozzle row 9 at the right end in the scanning direction.

The platen 5 is arranged below the ink jet head 4 to face the plurality of nozzles 10. The platen 5 extends through the entire length of recording paper P in the scanning direction to support the recording paper P from below. The conveyance roller 6 is arranged at the upstream side of the ink jet head 4 and the platen 5 in the conveyance direction. The conveyance roller 7 is arranged at the downstream side of the ink jet head 4 and the platen 5 in the conveyance direction. The conveyance rollers 6 and 7 are connected to a conveyance motor 87 depicted in FIG. 2 via gears (not depicted) and the like. If the conveyance motor 87 is driven, then the conveyance rollers 6 and 7 rotate to convey the recording paper P in the conveyance direction.

The maintenance unit 8 includes a cap 71, a suction pump 72, and a waste liquid tank 73. The cap 71 is arranged at the right side of the platen 5 in the scanning direction. Then, if the carriage 2 is moved to a maintenance position at the right side of the platen 5 in the scanning direction, then the plurality of nozzles 10 come to face the cap 71.

Figure 2:
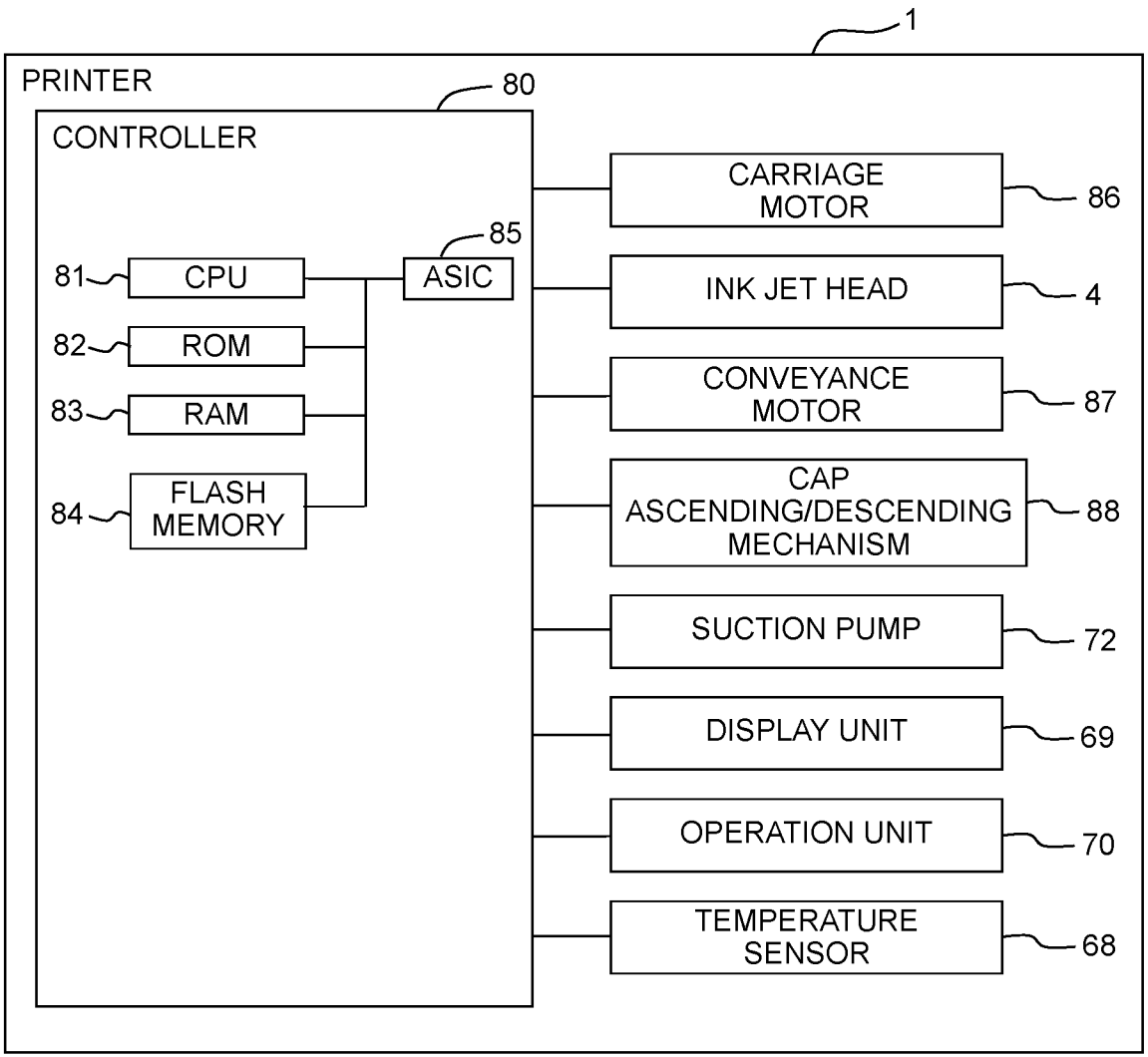
FIG. 2 is a block diagram depicting an electrical configuration of the printer.

Further, the cap 71 is ascended and descended by a cap ascending/descending mechanism 88 depicted in FIG. 2. Then, by moving the carriage 2 to the maintenance position to let the plurality of nozzles 10 face the cap 71, if the cap ascending/descending mechanism 88 causes the cap 71 to ascend, then the upper end of the cap 71 attach tightly to the nozzle surface 4*a* for the cap 71 to cover the plurality of nozzles 10. Note that when the cap 71 covers the plurality of nozzles 10, it may not attach tightly to the nozzle surface 4*a*. For example, when the cap 71 covers the plurality of nozzles 10, it may attach tightly to a frame (not depicted) or the like arranged around the nozzle surface 4*a* of the ink jet head 4.

The suction pump 72 is a tube pump or the like, and is connected with the cap 71 and the waste liquid tank 73. Then, in the maintenance unit 8, if the suction pump 72 is driven, with the plurality of nozzles 10 being covered by the cap 71 as described above, then the inks in the ink jet head 4 are discharged from the plurality of nozzles 10; that is, it is possible to perform a so-called suction purge. The inks discharged by way of the suction purge are retained in the waste liquid tank 73.

Further, in this embodiment, it is possible to selectively perform any suction purge among a plurality of types different in ink discharge quantity. In the suction purges in the plurality of types, for example, due to a difference in at least one of the drive time for the suction pump 72 and the rotation speed of the suction pump 72, the ink discharge quantity is varied.

Note that in the present context, for the sake of convenience, the description was made on the configuration of the cap 71 collectively covering all nozzles 10 from which the inks in the ink jet head 4 are discharged by the suction purge. However, without being limited to that, for example, the cap 71 may separately include a part to cover the plurality of nozzles 10 constituting the rightmost nozzle row 9 for discharging the black ink, and a part to cover the plurality of nozzles 10 constituting the three nozzle rows 9 on the left of the former for discharging the color inks of yellow, cyan and magenta. Then, the cap 71 may be configured such that in the suction purge, either the black ink or the color inks in the ink jet head 4 can be selectively discharged. Alternatively, for example, the cap 71 may be configured such that one cap 71 is individually provided for each nozzle row 9 and, in the suction purge, the inks can be discharged from the nozzles 10 individually according to each nozzle row 9.

<Electrical Configuration of the Printer>

Next, an electrical configuration of the printer 1 will be explained. As depicted in FIG. 2, the printer 1 includes a controller 80 for controlling the operation of the printer 1. The controller 80 is includes a CPU (Central Processing Unit) 81, a ROM (Read Only Memory) 82, a RAM (Random Access Memory) 83, a flash memory 84, an ASIC (Application Specific Integrated Circuit) 85, and the like. The controller 80 controls the operations of the carriage motor 86, the ink jet head 4, the conveyance motor 87, the cap ascending/descending mechanism 88, the suction pump 72, and the like.

Further, the printer 1 includes a display unit 69, an operation unit 70, and a temperature sensor 68 other than those in the above configuration. The display unit 69 is a liquid crystal display or the like. The controller 80 controls the display unit 69 to display information, messages and the like related to operations of the printer 1. The operation unit 70 includes buttons provided in the printer 1, a touch panel provided in the display unit 69, and the like. If a user operates with the operation unit 70, then a signal corresponding to the operation is inputted to the controller 80. The temperature sensor 68 detects the environmental temperature of the environment where the printer 1 is placed. The controller 80 receives signals corresponding to the environmental temperatures from the temperature sensor 68.

<Processes in Recording>

Next, an explanation will be made on processes when the printer 1 carries out recording. The printer 1 carries out recording by repeating a recording path and a conveyance operation. In the recording path, the carriage 2 is moved in the scanning direction while discharging the inks from the plurality of nozzles 10 of the ink jet head 4 with a discharging period corresponding to the moving speed of the carriage 2. In the conveyance operation, the recording paper P is conveyed by the conveyance rollers 6 and 7 through a predetermined distance.

Figure 3:
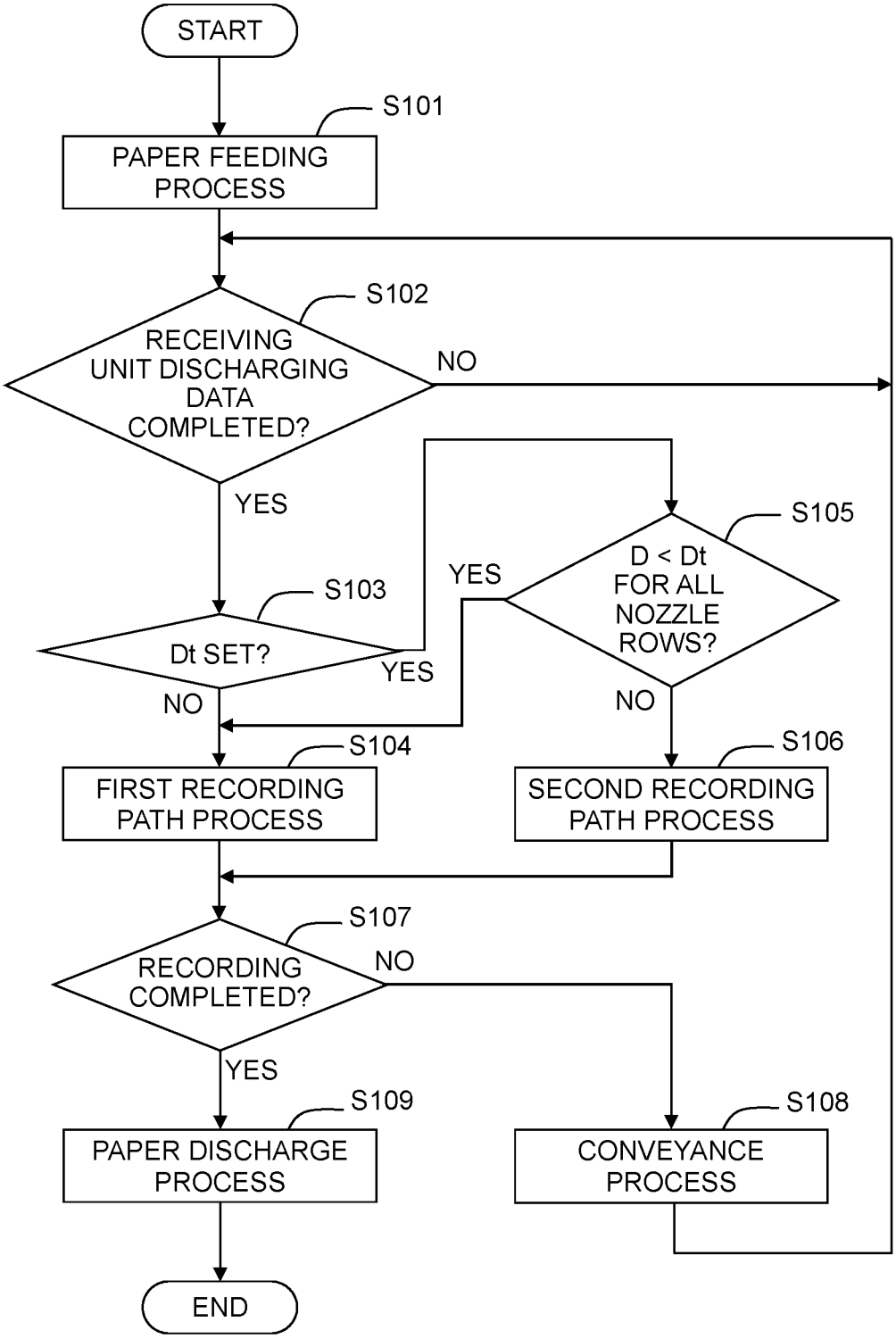
FIG. 3 is a flow chart depicting a processing flow of recording.

In the printer 1, on receiving a recording command of instruction for carrying out the recording, the controller 80 causes the recording to be carried out on the recording paper P by carrying out a process according to the flow of FIG. 3. Further, on this occasion, after the recording command, the controller 80 receives a discharging data indicating whether or not there is ink discharging in each discharging period for each of the plurality of nozzles 10 in the recording path. Further, on this occasion, the controller 80 receives a unit discharging data corresponding respectively to a plurality recording paths in the discharging data, in the order from the one corresponding to the previous recording path.

To be explained in more detail on the flow of FIG. 3, the controller 80 first carries out a paper feeding process (S101). In the paper feeding process of S101, the controller 80 controls the conveyance motor 87 and a paper feeding device (not depicted). By virtue of this, the recording paper P is conveyed by the conveyance rollers 6 and 7 and the paper feeding device such that the recording paper P may be positioned for such an area thereof to face the plurality of nozzles 10 as to be recorded in the first recording path.

Next, the controller 80 stands by until the completion of receiving the unit discharging data (S102: No). If the unit discharging data is received completely (S102: Yes), then the controller 80 determines whether or not a threshold value Dt is set for use in the step S105 and the like which will be described later on (S103). Here in this case, for the printer 1 in the initial state such as in the stage of manufacturing or the like, the threshold value Dt is not yet set, and the threshold value Dt will be set in an aftermentioned threshold value setting process.

If the threshold value Dt is not yet set (S103: No), then the controller 80 carries out a first recording path process (S104). In the first recording path process of S104, the controller 80 controls the carriage motor 86 to move the carriage 2 in the scanning direction while controlling the ink jet head 4 on the basis of the received unit discharging data to discharge the inks from the plurality of nozzles 10 in each discharging period. By virtue of this, in the first recording path process, in one recording path, a partial image is recorded to correspond to the unit discharging data.

If the threshold value Dt is already set (S103: Yes), then the controller 80 determines whether or not a duty D for the recording path is less than the threshold value Dt for all nozzle rows 9 on the basis of the received unit discharging data (S105). On this occasion, the duty D refers to a ratio of ink discharge amount when the inks are discharged from the plurality of nozzles 10 constituting the nozzle rows 9 in each discharging period on the basis of the unit discharging data, with respect to the ink discharge amount when the inks in the maximum size which can be discharged from all nozzles 10 constituting the nozzle rows 9 through all discharging periods in the recording path.

Then, if the duty D is less than the threshold value Dt for all nozzle rows 9 (S105: Yes), then the controller 80 carries out the first recording path process (S104). If the duty D is equal to or more than the threshold value Dt for any nozzle row 9 (S105: No), then the controller 80 carries out a second recording path process (S106).

In the second recording path process of 5106, the controller 80 divides the received unit discharging data into a plurality of divided data corresponding to a plurality of recording paths. On this occasion, the controller 80 divides the unit discharging data into the plurality of divided data such that the duty when the recording path is carried out on the basis of each divided data may be less than the threshold value Dt.

Then, the controller 80 controls the carriage motor 86 to move the carriage 2 in the scanning direction while controlling the ink jet head 4 on the basis of the divided data, to perform the recording path by discharging the inks from the plurality of nozzles 10 with each discharging period. That is, in the second recording path process, based on the plurality of recording paths carried out corresponding to the plurality of divided data, the partial image corresponding to the unit discharging data is recorded.

After the first recording path process of S104 or the second recording path process of S106, the controller 80 determines whether or not the recording on the recording paper P is finished (S107). If the recording on the recording paper P is not yet finished (S107: No), then the controller 80 carries out a conveyance process (S108), and then returns the process to the step S102. In the conveyance process of 5108, the controller 80 controls the conveyance motor 87 to cause the conveyance rollers 6 and 7 to convey the recording paper P through a predetermined distance.

If the recording on the recording paper P is finished (S107: Yes), then the controller 80 carries out a paper discharge process (S109), with which the process is ended. In the paper discharge process of S109, the controller 80 controls the conveyance motor 87 to cause the conveyance rollers 6 and 7 to discharge the recording paper P.

<Process in Receiving the User's Purge Instruction Signal>

In this embodiment, the user can input a purge instruction signal of instruction for the printer 1 to perform a suction purge by an operation with the operation unit 70. Further, on this occasion, the user can operate with the operation unit 70 to select one suction purge among the aforementioned plurality of types of suction purge. The controller 80 carries out the process according to the flow of FIG. 4 when receiving the purge instruction signal.

Figure 4:
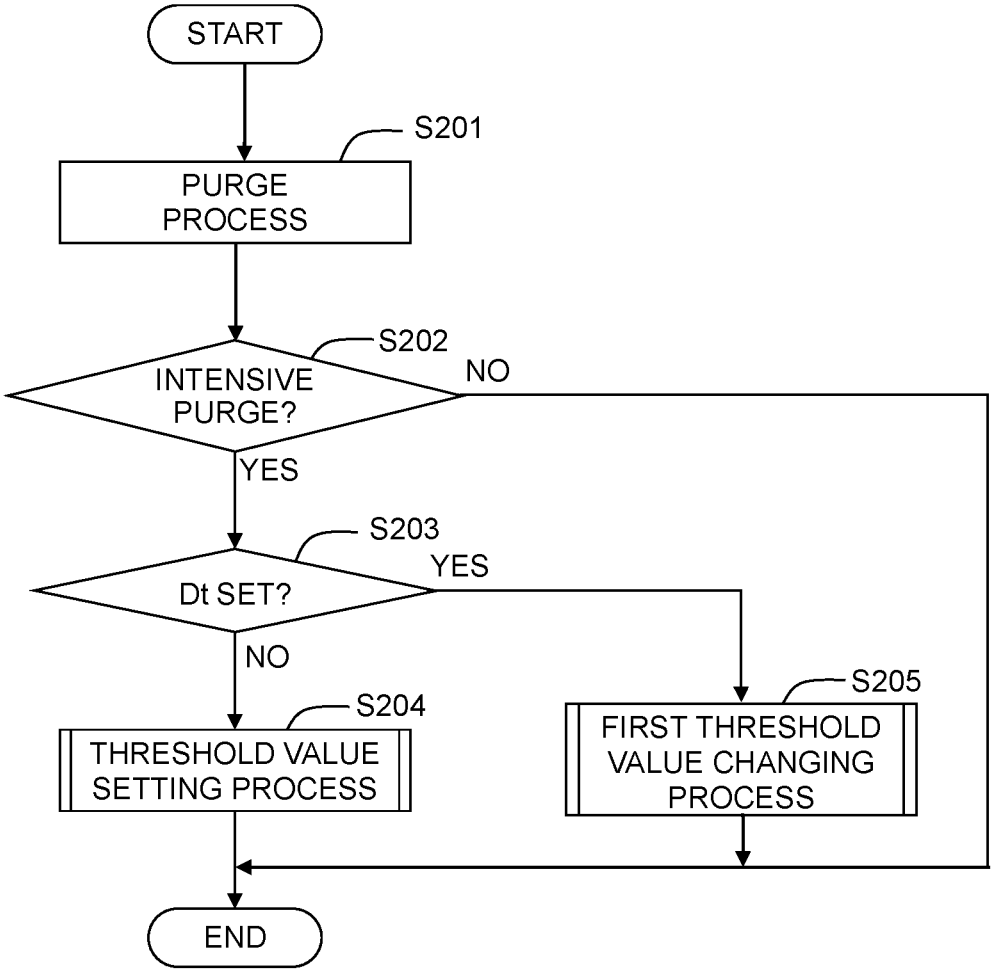
FIG. 4 is a flow chart depicting a processing flow when a user inputs a purge instruction signal.

To explain the flow of FIG. 4 in more detail, the controller 80 first carries out a purge process (S201). In the purge process of S201, the controller 80 controls the carriage motor 86, the cap ascending/descending mechanism 88, the suction pump 72 and the like, to perform the suction purge selected by the user.

Next, the controller 80 determines whether or not the user has selected an intensive purge which is the suction purge whose ink discharge quantity is the largest among the plurality of types of suction purge (S202). If the user has selected another suction purge than the intensive purge (S202: No), then the process is ended with this step. If the user has selected the intensive purge (S202: Yes), then the controller 80 determines whether or not the threshold value Dt is set (S203).

If the threshold value Dt is not yet set (S203: No), then the controller 80 sets the threshold value Dt by carrying out a threshold value setting process (S204), and then ends the process. The threshold value setting process of S204 will be explained in detail later on.

If the threshold value Dt is already set (S203: Yes), then the controller 80 changes the threshold value Dt by carrying out a first threshold value changing process (S205), and then ends the process. The first threshold value changing process of S205 will be explained in detail later on.

<Upper Limit Value and Lower Limit Value of the Threshold Value>

Figure 5:
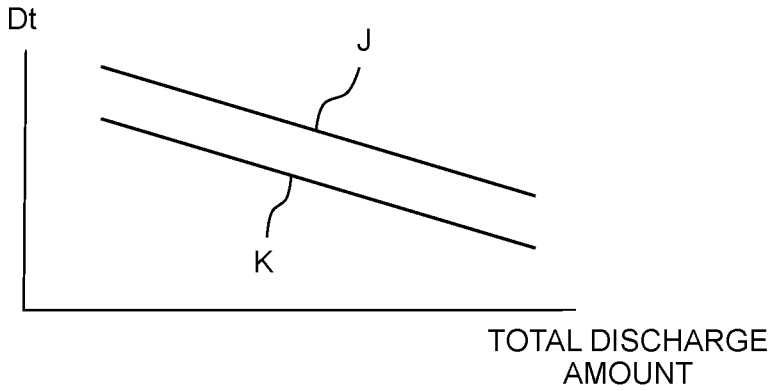
FIG. 5 is drawn for explaining a relation between a total discharge amount, and the upper limit value and lower limit value of a threshold value.

Next, an explanation will be made on the threshold value setting process of S204, the first threshold changing process of S205, and an upper limit value and a lower limit value of range of the threshold value Dt to be used in the above processes. In this embodiment, as depicted in FIG. 5, the flash memory 84 stores the data indicating a relation between the total discharge amount which is the accumulated value of the ink discharge amount from the plurality of nozzles 10 in the ink jet head 4, and the upper limit value J and the lower limit value K of the range of the threshold value Dt. As depicted in FIG. 5, in this embodiment, the larger the total discharge amount, the smaller the both of the upper limit value J and the lower limit value K of the range of the threshold value Dt. Further, in this embodiment, the flash memory 84 stores the data indicating a relation between the total discharge amount as depicted in FIG. 5, and the upper limit value J and the lower limit value K of the range of the threshold value Dt, individually for each of a plurality of environmental temperatures for the ink jet head 4.

<Threshold Value Setting Process>

Figure 6A:
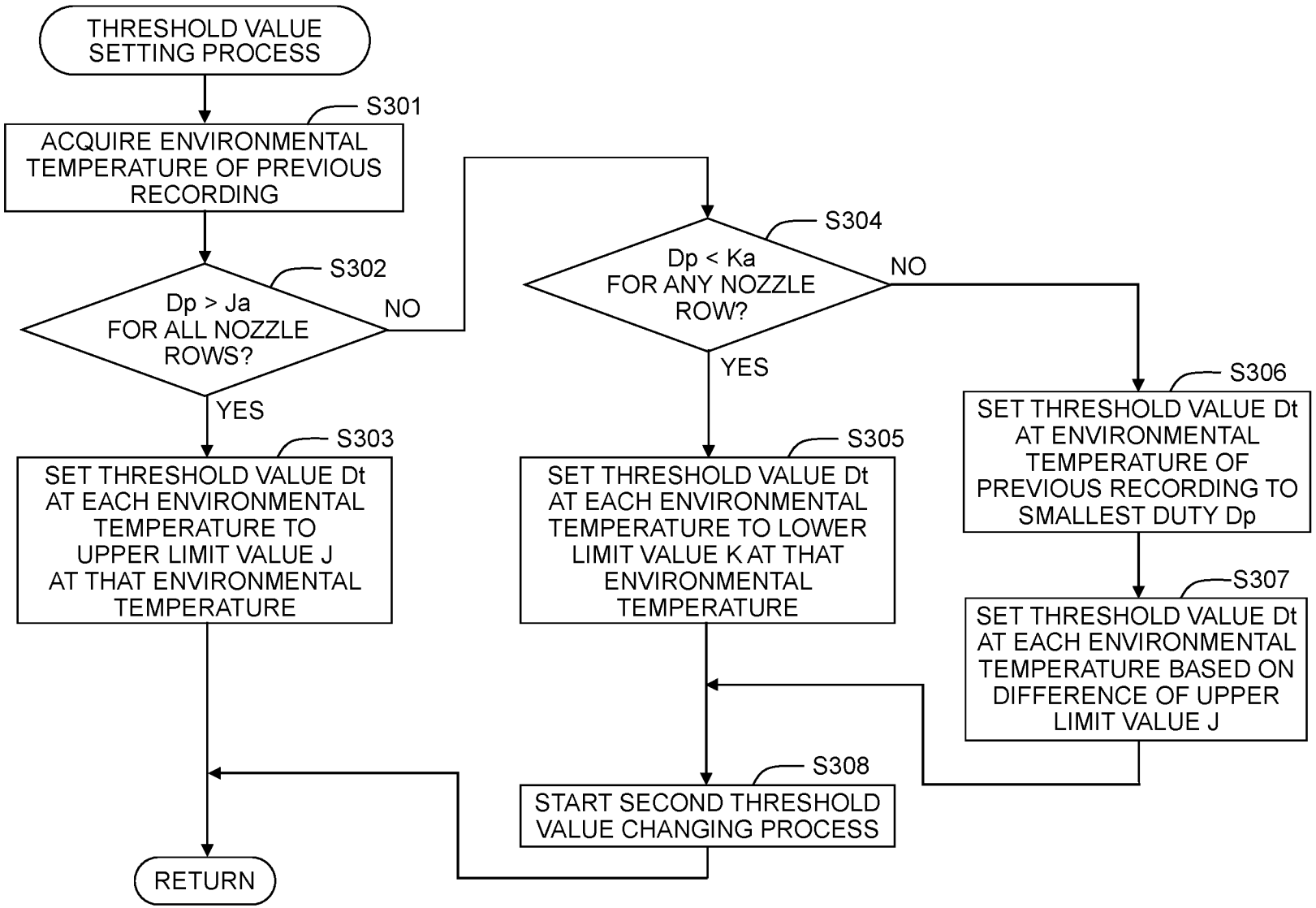
FIG. 6A is a flow chart depicting a threshold value setting process in FIG. 4.

Next, the threshold value setting process of S204 will be explained. As depicted in FIG. 6A, in the threshold value setting process, the controller 80 first acquires information of the environmental temperature of the previous recording (S301). For example, the controller 80 causes the flash memory 84 to store the information of environmental temperature acquired on the basis of a signal from the temperature sensor 68 in the previous recording. The controller 80 reads out this information of environmental temperature from the flash memory 84 in the step S301.

Next, the controller 80 determines whether or not a duty Dp for each nozzle row 9 in the previous recording is larger than an upper limit value in recording Ja of the threshold value Dt at the environmental temperature acquired in the step S301 (to be referred to below as "upper limit value Ja in recording") (S302). If the duty Dp is larger than the upper limit value in recording Ja for all nozzle rows 9 (S302: Yes), then the controller 80 sets the threshold value Dt at each environmental temperature to the upper limit value J at the environmental temperature (S303), and then returns the process to the flow of FIG. 4. In this context, the term "set the threshold value Dt to the upper limit value J" refers to setting the threshold value Dt to the upper limit value J which decreases as the total discharge amount increases as depicted in FIG. 5. By virtue of this, the threshold value Dt at each environmental temperature decreases as the total discharge amount increases thereafter until the threshold value Dt is changed the next time.

Figure 7A:
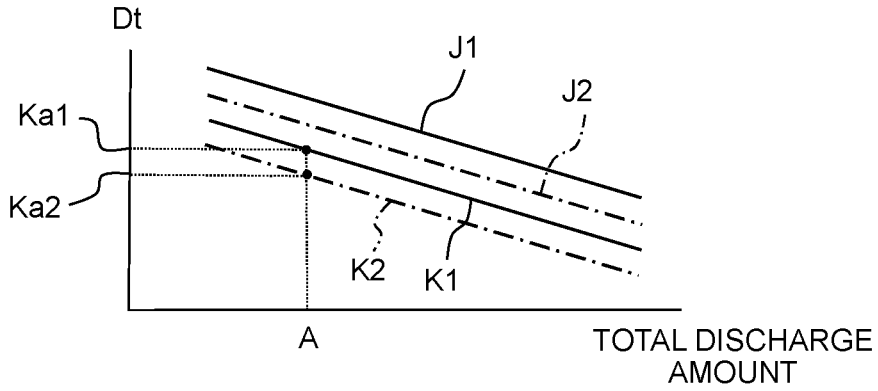
FIG. 7A is drawn for explaining a method for setting the threshold value at each environmental temperature to the upper limit value or the lower limit value in the previous recording.

An example will be taken for explaining the setting of the threshold value Dt in the step S303. For example, as depicted in FIG. 7A, assume that the flash memory 84 stores an upper limit value J1 when the environmental temperature is T1 and an upper limit value J2 when the environmental temperature is T2. In this case, the controller 80 sets the threshold value Dt to the upper limit value J1 when the environmental temperature is T1, and sets the threshold value Dt to the upper limit value J2 when the environmental temperature is T2.

If the duty Dp is equal to or smaller than the upper limit value in recording Ja for any of the nozzle rows 9 (S302: No), then the controller 80 determines whether or not the duty Dp for any of the nozzle rows 9 is smaller than a lower limit value in recording Ka in the previous recording at the environmental temperature acquired in the step S310 (to be referred to as "lower limit value Ka in recording") (S304). Note that if the duty Dp for two nozzle rows 9 or more is not larger than the upper limit value in recording Ja, then the determination of S304 is carried out on the basis of the nozzle row 9 of the smallest duty Dp among those nozzle rows 9. Much the same is true on the duty Dp for an aftermentioned determination of S402.

If the duty Dp is smaller than the lower limit value in recording Ka for any of the nozzle rows 9 (S304: Yes), then the controller 80 sets the threshold value Dt at each environmental temperature to the lower limit value in recording Ka at that environmental temperature (S305). By virtue of this, the threshold value Dt at each environmental temperature is maintained, thereafter, at the lower limit value in recording Ka until the threshold value Dt is changed the next time.

An example will be taken for explanation of setting the threshold value Dt in the step S305. For example, as depicted in FIG. 7A, assume that the flash memory 84 stores a lower limit value K1 at the environmental temperature of T1 and a lower limit value K2 at the environmental temperature of T2, and that A is the total discharge amount in the previous recording. In this case, the controller 80 sets the threshold value Dt at the environmental temperature of T1 to a lower limit value in recording Ka1 when the total discharge amount is A, and sets the threshold value Dt at the environmental temperature of T2 to a lower limit value in recording Ka2 when the total discharge amount is A.

If the duty Dp for all nozzle rows 9 is not smaller than the lower limit value in recording Ka (S304: No), then the controller 80 sets the threshold value Dt at the environmental temperature acquired in the step S301 to the smallest duty Dp among the duties Dp of the four nozzle rows 9 (S306). Next, based on the smallest duty Dp set in the step S306, and the difference between the upper limit value J at each environmental temperature and the upper limit value J acquired in the step S301, the controller 80 sets the threshold value Dt at each environmental temperature.

Figure 7B:
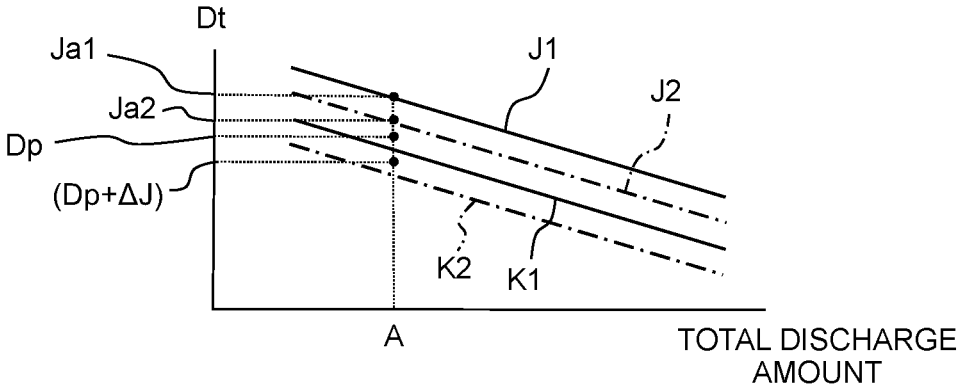
FIG. 7B is drawn for explaining a method for determining a set value at each environmental temperature on the basis of the duty in the previous recording.

An example will be taken for explanation of setting the threshold value Dt in the step S307. For example, as depicted in FIG. 7B, assume that the flash memory 84 stores information of the aforementioned upper limit value J1 and upper limit value J2, that A is the total discharge amount in the previous recording, and that T1 is the environmental temperature in the previous recording. In this case, let the upper limit value J1 be an upper limit value in recording Ja1 when the total discharge amount is A, and the upper limit value J2 be an upper limit value in recording Ja2 when the total discharge amount is A. Then, letting (Ja2−Ja1) be ΔJ, the threshold value Dt at the environmental temperature of T2 is set to (Dp+ΔJ) in the step S307. Note that in FIG. 7B, because the upper limit value in recording Ja2 is smaller than the upper limit value in recording Ja1, ΔJ is negative in value. Therefore, (Dp+ΔJ) is smaller than Dp. Conversely to FIG. 7B, if the upper limit value in recording Ja2 is larger than the upper limit value in recording Ja1, then ΔJ is positive in value. Therefore, (Dp+ΔJ) is larger than Dp.

Then, after the threshold value Dt is set at each environmental temperature in the step S305 or the steps S306 and S307, the controller 80 starts a second threshold value changing process (S308), and then returns the process to the flow of FIG. 4. The second threshold value changing process will be explained in detail later on.

<First Threshold Value Changing Process>

Figure 6B:
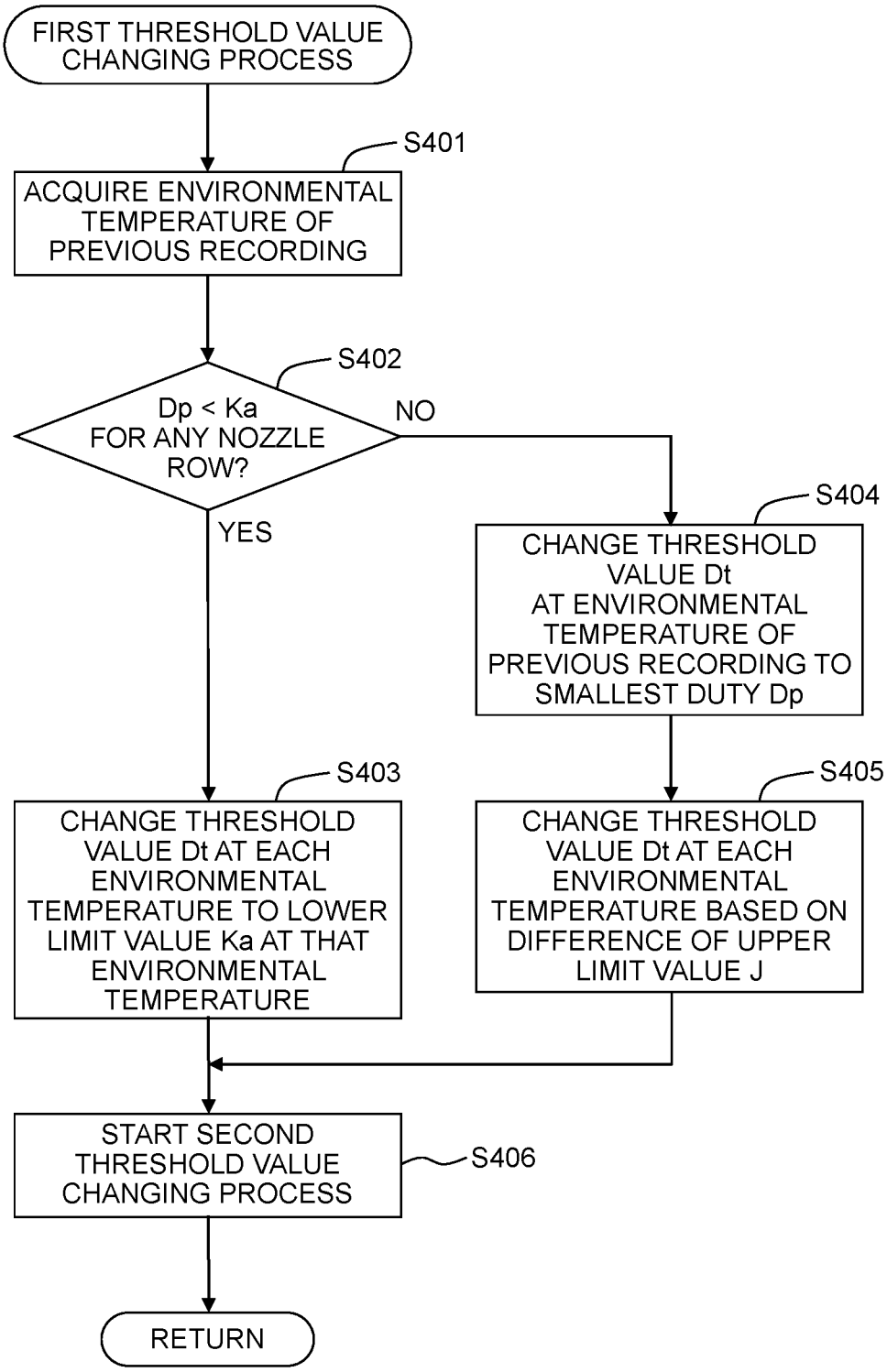
FIG. 6B is a flow chart depicting a first threshold value changing process in FIG. 4.

Next, the first threshold value changing process of S205 will be explained. As depicted in FIG. 6B, in the first threshold value changing process, the controller 80 first acquires the information of environmental temperature in the previous recording (S401) in the same manner as in the step S301.

Then, the controller 80 determines whether or not the duty Dp for any nozzle row 9 in the previous recording is less than the lower limit value in recording Ka at the environmental temperature acquired in the step S401 (to be referred to below as "lower limit value Ka in the previous recording") (S402). If the duty Dp for any nozzle row 9 is less than the lower limit value in recording Ka (S402: Yes), then in the same manner as in the step S305, the controller 80 changes the threshold value Dt at each environmental temperature to the lower limit value K at that environmental temperature (S403).

If the duty Dp for all nozzle rows 9 is equal to or more than the lower limit value in recording Ka (S402: No), then in the same manner as in the step S306, the controller 80 changes the threshold value Dt at the environmental temperature acquired in the step S401 to the smallest duty Dp among the duties Dp for the four nozzle rows 9 (S404). Then, in the same manner as in the step S307, the controller 80 changes the threshold value Dt at another environmental temperature on the basis of the smallest duty Dp set in the step S404, and the difference between the upper limit value J at each environmental temperature and the upper limit value J and the upper limit value J at the environmental temperature acquired in the step S401 (S405).

Then, after changing the threshold value Dt at each environmental temperature in the step S403 or the steps S404 and S405, the controller 80 starts the second threshold value changing process (S406), and returns the process to the flow of FIG. 4.

<Second Threshold Value Changing Process>

Figure 8:
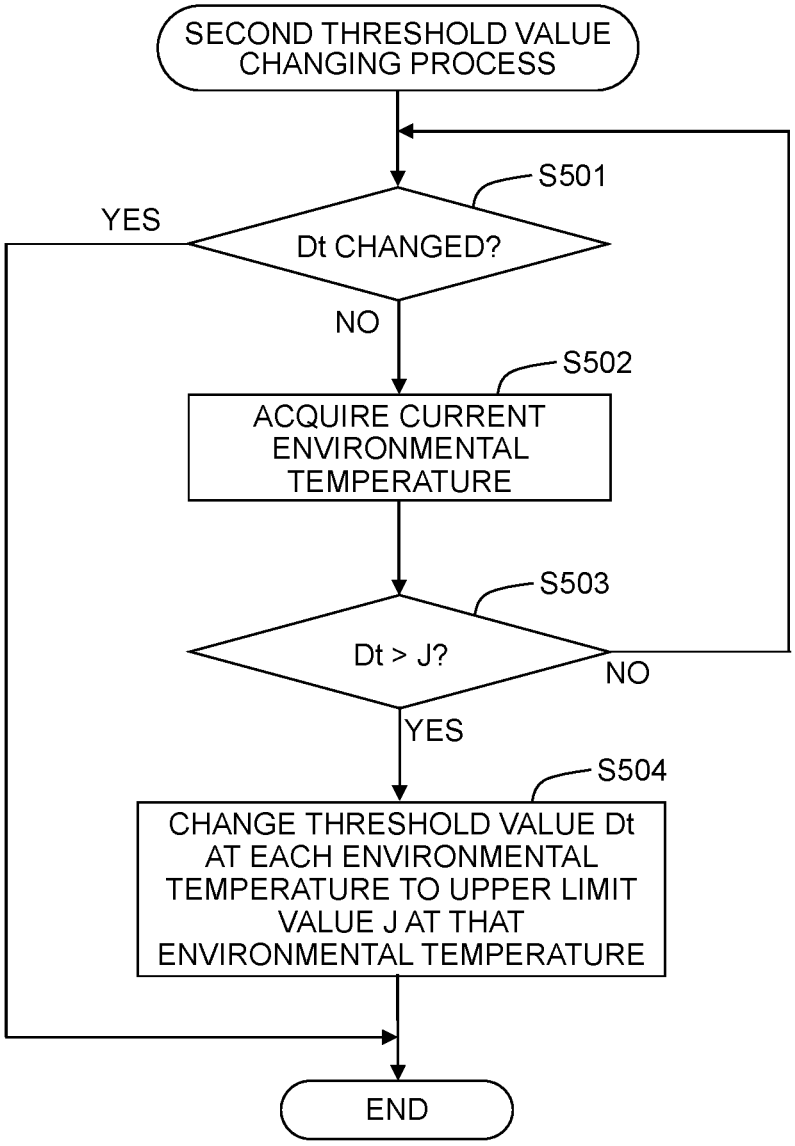
FIG. 8 is a flow chart depicting a second threshold value changing process.

Next, an explanation will be made on the second threshold value changing process started in the step S308 or S406. As depicted in FIG. 8, in the second threshold value changing process, the controller 80 determines whether or not the threshold value Dt is changed (S501). That is, the controller 80 determines whether or not the threshold value Dt is changed in the abovementioned step S403 or steps S404 and S405 after the second threshold value changing process is started.

If the threshold value Dt is changed (S501: Yes), then the process is ended. If the threshold value Dt is not changed (S501: No), then the controller 80 acquires information of the current environmental temperature on the basis of a signal from the temperature sensor 68 (S502). Then, the controller 80 determines whether or not the threshold value Dt exceeds the upper limit value J at the environmental temperature acquired in the step S502 (S503).

If the threshold value Dt does not exceed the upper limit value J (S503: No), then the process returns to the step S501. If the threshold value Dt exceeds the upper limit value J (S503: Yes), then the controller 80 changes the threshold value Dt at each environmental temperature to the upper limit value J at that environmental temperature in the same manner as in the step S303 (S504), and ends the process.

<An Example of Change of the Threshold Value Dt>

Figure 9:
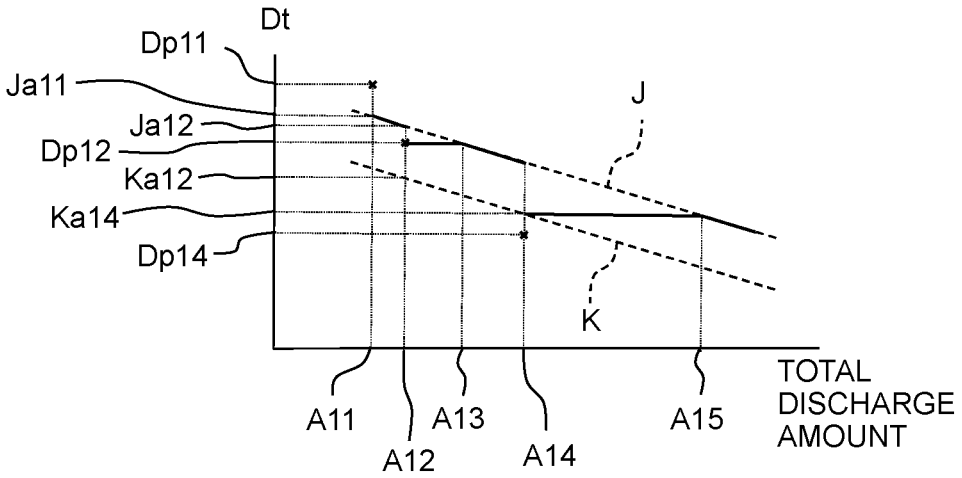
FIG. 9 is drawn for explaining an example of change in the threshold value in the embodiment described above.

Next, according to the above description, FIG. 9 will be used to explain an example of variation of the threshold value Dt when the threshold value Dt is set or changed. Note that for the sake of convenience, the environmental temperature is supposed to be constant, and the explanation will be made on setting or changing the threshold value Dt at that environmental temperature. Further, the Dp11, Dp12 and Dp14 of FIG. 9 are the smallest duties Dp for the four nozzle rows 9.

In this example, with the threshold value Dt being not yet set, assume that a purge instruction signal is received giving the user's initial instruction for the intensive purge, and A11 is the total discharge amount in the recording right before receiving that purge instruction signal. On this occasion, because the duty Dp 11 which is the duty Dp in that recording is larger than the upper limit value in recording Ja11 for that recording (S302: Yes), the threshold value Dt is set to the upper limit value J (S303).

Then, the threshold value Dt set at the upper limit value J decreases as the total discharge amount increases. Further, when receiving the purge instruction signal the next time giving the user's instruction for the intensive purge, assume that A12 is the total discharge amount in the recording right before receiving that purge instruction signal. On this occasion, because the duty Dp 12 which is the duty Dp in that recording is between the lower limit value in recording Ka12 in that recording and the upper limit value in recording Ja12 in that recording (S402: No), the threshold value Dt is changed to the duty Dp12 (S404). Further, the second threshold value changing process is started thereafter (S406).

Then, in the period thereafter until the total discharge amount becomes A13, assume that the purge instruction signal is not received for the user to give instruction for the intensive purge, and no change is made in setting the threshold value Dt in the step S403 or the steps S404 and S405 (S501: No). On this occasion, until the total discharge amount becomes A13, because the duty Dp12 is smaller than the upper limit value J (S503: No), the threshold value Dt is maintained at the duty Dp12. Then, when the total discharge amount becomes A13, because the upper limit value J reaches to the duty Dp12 (S503: Yes), the threshold value Dt is changed to the upper limit value J (S504). Then, the second threshold value changing process is ended.

Further, in the next stage, on receiving the purge instruction signal giving the user's instruction for the intensive purge, assume that A14 is the total discharge amount in the recording right before receiving that purge instruction signal. On this occasion, because the duty Dp 14 which is the duty Dp in that recording is smaller than the lower limit value in recording Ka14 in that recording (S402: Yes), the threshold value Dt is changed to the lower limit value in recording Ka14 (S403). Further, the second threshold value changing process is started thereafter (S406).

Then, in the period thereafter until the total discharge amount becomes A15, assume that the purge instruction signal is not received for the user to give instruction for the intensive purge, and no change is made in setting the threshold value Dt in the step S403 or the steps S404 and S405 (S501: No). On this occasion, until the total discharge amount becomes A15, because the threshold value Dt is smaller than the upper limit value J (S503: No), the threshold value Dt is maintained at the lower limit value in recording Ka14. Then, when the total discharge amount becomes A15, because the upper limit value J reaches to the lower limit value in recording Ka14 (S503: Yes), the threshold value Dt is changed to the upper limit value J (S504). Then, the second threshold value changing process is ended. In the same manner as described above, thereafter, the threshold value is changed, too.

Note that FIG. 9 shows a case of not receiving the purge instruction signal giving the user's instruction for the intensive purge after the threshold value Dt is changed to the duty Dp12, until the total discharge amount becomes A13. Further, FIG. 9 shows a case of not receiving the purge instruction signal giving the user's instruction for the intensive purge after the threshold value Dt is changed to the lower limit value in recording Ka14, until the total discharge amount becomes A15.

On the other hand, during those periods, in a case of receiving the purge instruction signal giving the user's instruction for the intensive purge, based on whether or not the duty Dp in the recording right before receiving that signal is smaller than the lower limit value in recording Ka in that recording, the threshold value Dt is changed to either the duty Dp or the lower limit value in recording Ka (S402 to S404).

<Effects>

When the printer 1 is in printing, if the duty D indicated by the unit discharging data is high, then in the recording path, if the inks are discharged from the plurality of nozzles 10 on the basis of the unit discharging data, then a so-called under refilling may occur, that is, a case of insufficient supply of the inks from the ink cartridges 14 to the ink jet head 4.

Therefore, in this embodiment, when the printer 1 is in recording, if the duty D for all nozzle rows 9 is less than the threshold value Dt, then the first recording path process is carried out. Therefore, the inks are discharged from the plurality of nozzles 10 on the basis of the unit discharging data through one recording path. If the duty D for any nozzle row 9 is equal to or more than the threshold value Dt, then by carrying out the second recording path process where the unit discharging data is divided into a plurality of divided data and, based on the plurality of divided data and through a plurality of recording paths, the inks are discharged from the plurality of nozzles 10. By virtue of this, when the second recording path process is carried out, the time taken for recording the partial image corresponding to the unit discharging data is longer than that when the first recording path process is carried out. Therefore, it is possible to make the under refilling less likely to happen.

In this context, when the second recording path process is carried out, because the number of recording paths increases, the time for recording is longer than that when the first recording path process is carried out. Further, the smaller the threshold value Dt, the less likely to happen the under refilling. However, if the threshold value Dt is too small, then the second recording path process has to be carried out even if the duty D is so small that the under refilling will not happen. As a result, the time for recording is liable to become unnecessarily long.

Further, if the under refilling has happened, then a comparatively large amount of air is entering the ink jet head 4. Therefore, if a large quantity of the inks is not discharged by the suction purge, then it is not possible to discharge the air. Further, if the printer 1 does not perform recording normally, then the user may operate with the operation unit 70 to input the purge instruction signal. Accordingly, if the under refilling is happening, then it is usually proposed to input the purge instruction signal giving the instruction for the intensive purge.

Therefore, in this embodiment, with the threshold value Dt being set, when receiving the purge instruction signal giving the user's instruction for the intensive purge, the controller 80 lowers the threshold value Dt according to the duty Dp as described earlier on. That is, by generally setting the threshold value Dt to a larger value, it is possible to prevent the time for recording from becoming unnecessarily long. Then, if the under refilling happens in reality, then the threshold value Dt is lowered according to the duty Dp and, thereafter, it is possible to make the under refilling less likely to happen.

Further, in this embodiment, with the threshold value Dt being set at the upper limit value J, if the under refilling happens in a recording with the duty Dp less than the upper limit value in recording Ja, then the threshold value Dt is lowered down to the duty Dp. By virtue of this, it is possible thereafter to make the under refilling less likely to happen after reducing the threshold value Dt by an appropriate value.

Further, the more the total discharge amount, the more likely to happen the under refilling due to the influence of thickened inks in the ink jet head 4. Therefore, the larger the total discharge amount, the smaller the upper limit value J stored in the flash memory 84 of this embodiment. Then, if the under refilling happens in a recording with the duty Dp less than the upper limit value in recording Ja, then threshold value Dt is set to that duty Dp. Thereafter, until the upper limit value J reaches to the duty Dp, as far as the threshold value Dt is not changed next in any of the steps S403 to S405, the threshold value Dt is maintained at being set at the duty Dp. Then, if the upper limit value J decreases as the total discharge amount increases, and thus reaches to the duty Dp, then the threshold value Dt is changed to the upper limit value J. By virtue of this, it is possible to set the threshold value Dt appropriately according to the change of the upper limit value J due to the change of the total discharge amount.

Further, usually the lower limit value K of threshold value Dt is set to a value where the under refilling will not occur almost definitely if the duty D is less than the lower limit value K. Therefore, if the duty D is less than the lower limit value K, then there is a low possibility of giving rise to the under refilling. In this context, when receiving the purge instruction signal giving the user's instruction for the intensive purge, the threshold value Dt is changed to the lower limit value in recording Ka if the duty Dp of the previous recording is less than the lower limit value in recording Ka in that recording. By virtue of this, it is possible to prevent the second recording path process from be carried out more than necessary due to a too small threshold value Dt.

Further, the larger the total discharge amount, the smaller the upper limit value J stored in the flash memory 84 of this embodiment. Therefore, in this embodiment, as described above, after the threshold value Dt is changed to the lower limit value in recording Ka, until the upper limit value J reaches the lower limit value in recording Ka, as far as the threshold value Dt is not changed next in any of the steps S403 to S405, the threshold value Dt is maintained at being set at the lower limit value in recording Ka. Then, if the upper limit value J decreases as the total discharge amount increases, and thus reaches the lower limit value in recording Ka (S503: Yes), then the threshold value Dt is changed to the upper limit value J (S504). By virtue of this, it is possible to set the threshold value Dt appropriately according to the change of the upper limit value J due to the change of the total discharge amount.

Further, in this embodiment, in the above initial state, the threshold value Dt is not yet set. Therefore, the printer 1 carries out the first recording path process in the initial recording without depending on the duty D. By virtue of this, it is possible to prevent the time for recording from getting too long. Thereafter, when first receiving the purge instruction signal giving the user's instruction for the intensive purge, the threshold value Dt is set as described above. Then, when the printer 1 is in recording, if the duty D is less than the threshold value Dt for all nozzle rows 9, the first recording path process is carried out. Further, if the duty D for any nozzle row 9 is equal to or more than the threshold value Dt, then the second recording path process is carried out. By virtue of this, it is possible to make the under refilling less likely to happen after the threshold value Dt is set.

Further, usually, the upper limit value J of the threshold value Dt is set to a value for the under refilling to happen almost definitively if the duty D is equal to or more than the upper limit value J. Therefore, in this embodiment, when first receiving the purge instruction signal giving the user's instruction for the intensive purge, if the duty Dp of the previous recording is higher than the upper limit value in recording Ja, then the threshold value Dt is set to the upper limit value J. By virtue of this, it is possible to prevent the threshold value Dt from being lowered more than necessary while making the under refilling less likely to happen.

Further, in this embodiment, the flash memory 84 stores the information of the upper limit value J for each of a plurality of environmental temperatures. Then, in the steps S303, S305 and S403, setting or changing is made on the threshold value Dt at the environmental temperature in the previous recording and the threshold value Dt at each environmental temperature other than the former. Further, after setting or changing the threshold value Dt at the environmental temperature in the previous recording in the step S306 or S404, based on the difference between that threshold value Dt and the upper limit value J between the different environmental temperatures, setting or changing is made on the threshold values Dt at the other environmental temperatures. By virtue of this, it is possible to set or change the threshold value Dt appropriately at each environmental temperature.

Note that in this embodiment, the printer 1 corresponds to the "liquid discharging apparatus" of the present teaching. Further, the ink jet head 4 corresponds to the "liquid discharging head" of the present teaching. Further, the ink jet cartridge 14 corresponds to the "tank" of the present teaching. Further, the flash memory 84 corresponds to the "memory" of the present teaching. Further, the purge instruction signal giving the user's instruction for the intensive purge corresponds to the "signal for changing the threshold value" of the present teaching.

Further, one recording path carried out by the first recording path process corresponds to the "discharging operation" and the "first discharging operation" of the present teaching, and the time taken for the one recording path corresponds to the "predetermined time period" of the present teaching. Further, the duty D corresponds to the "discharge amount over the predetermined time period" of the present teaching. Further, the plurality of recording paths carried out by the second recording path process correspond to the "discharging operation" and the "second discharging operation" of the present teaching, and the total time taken for the plurality of recording paths is longer than the above "predetermined time period".

Further, the environmental temperature of T1 corresponds to the "first temperature" of the present teaching whereas the environmental temperature of T2 corresponds to the "second temperature" of the present teaching. Further, the upper limit values J, J1 and J2 correspond to the "upper limit value" of the present teaching, wherein J1 corresponds to the "first upper limit value" of the present teaching whereas J2 corresponds to the "second upper limit value" of the present teaching. Further, the upper limit values in recording Ja, Ja1 and Ja2 correspond to the "discharging-time upper limit value" of the present teaching, wherein the upper limit value in recording Ja1 corresponds to the "discharging-time first upper limit value" of the present teaching whereas the upper limit value in recording J2 corresponds to the "discharging-time second upper limit value in discharging" of the present teaching. Further, the lower limit values K, K1 and K2 correspond to the "lower limit value" of the present teaching, and the lower limit values in recording Ka, Ka1 and Ka2 correspond to the "discharging-time lower limit value" of the present teaching. Further, the duty Dp set as the threshold value Dt in the step S306 or S404 corresponds to the "predetermined value" of the present teaching.

Hereinabove, the explanation was made on an embodiment of the present teaching. However, the present teaching is not limited to the embodiment described above but can undergo various changes and modifications without departing from what is set forth in the appended claims.

In the above embodiment, the flash memory 84 stores the information of the upper limit value J as depicted in FIG. 5 for the plurality of environmental temperatures. Then, in the steps S303, S305 and S403, setting or changing is made on the threshold value Dt at the environmental temperature in the previous recording and the threshold value Dt at each environmental temperature other than the former. Further, after setting or changing the threshold value Dt at the environmental temperature in the previous recording in the step S306 or S404, based on the difference between that threshold value Dt and the upper limit value J between the different environmental temperatures, setting or changing is made on the threshold values Dt at the other environmental temperatures. However, the present teaching is not limited to that.

For example, in the steps S303, S305 and S403, setting or changing may be made only on the threshold value Dt at the environmental temperature in the previous recording. Further, after setting or changing the threshold value Dt at the environmental temperature in the previous recording in the step S306 or S404, setting or changing on the threshold values Dt at the other environmental temperatures may be omitted.

Further, in the above embodiment, in the step S305, S403, S306 or S404, the controller 80 first sets or changes the threshold value Dt to either the lower limit value in recording Ka or the duty Dp, and then changes the setting of the threshold value Dt by carrying out the process according to the flows of FIGS. 4, 6A and 6B when receiving the purge instruction signal giving the user's instruction for the intensive purge, also for the period when the upper limit value J decreases until reaching the threshold value Dt. However, the present teaching is not limited to that.

For example, in the above period, even on receiving the purge instruction signal giving the user's instruction for the intensive purge, the controller 80 may only perform the purge process to maintain the threshold value Dt.

Further, on this occasion, during the above period, when receiving the purge instruction signal giving the user's instruction for the intensive purge, the controller 80 may change the threshold value Dt to an upper limit value J' derived from the upper limit value J which has been lowered to the upper limit value J' such that the upper limit value for that recording may be equal to the duty Dp of that recording.

Figure 11:
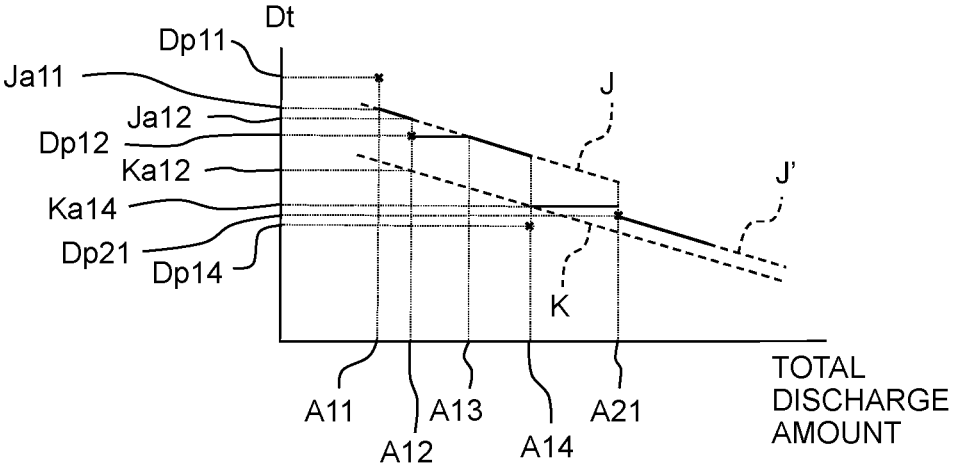
FIG. 11 is drawn for explaining an example of change in the threshold value when the purge instruction signal is received to give the user's instruction for an intensive purge if the threshold value is maintained at the lower limit value in recording.

For example, in an example depicted in FIG. 11 corresponding to FIG. 9 explained in the above embodiment, during the period when the threshold value Dt is maintained at a lower limit value in recording Ka14, assume that the purge instruction signal giving the instruction for the intensive purge is received, and A21 is the total discharge amount for the immediate previous recording. On this occasion, the upper limit value J is lowered to the upper limit value J' such that the upper limit value J' when the total discharge amount is A21 may be equal to a duty Dp 21 of that recording. Then, the threshold value Dt is changed to the upper limit value J'. Further, after that, in the same manner as explained in the above embodiment with reference to the upper limit value J', the threshold value Dt is changed.

Note that in the above explanation, such an example was taken as the case of receiving the purge instruction signal giving the user's instruction for the intensive purge if the threshold value Dt is maintained at the lower limit value in recording Ka14. Likewise, much the same is true on the case of receiving the purge instruction signal giving the user's instruction for the intensive purge, when the threshold value Dt is maintained at the duty Dp12.

Further, the larger the total discharge amount, the smaller the upper limit value J of the threshold value Dt stored in the flash memory 84 of the above embodiment. Then, either after the threshold value Dt is set or changed to the lower limit value in recording Ka in the step S305 or S403 or after the threshold value Dt is set or changed to the duty Dp in the step S306 or S404, if the upper limit value J decreases such that the threshold value Dt reaches the upper limit value J (S503: Yes), then the threshold value Dt is set to the upper limit value J (S504). However, the present teaching is not limited to that.

Figure 10:
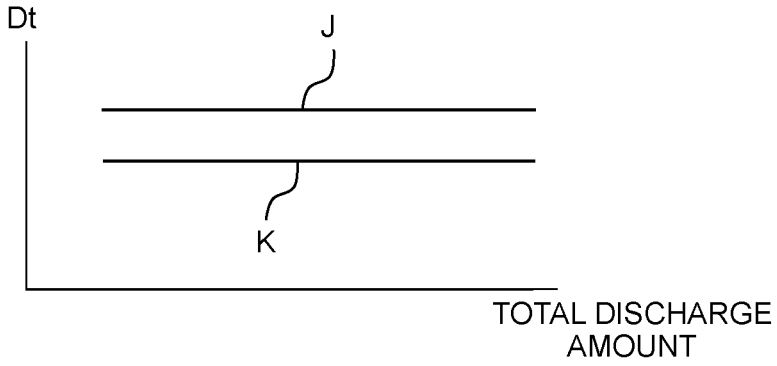
FIG. 10 is drawn for explaining a relation between the total discharge amount and the upper limit value and lower limit value of a threshold value according to a modified embodiment.

In a modified embodiment, as depicted in FIG. 10, the upper limit value J and the lower limit value K stored in the flash memory 84 are constant regardless of the total discharge amount. Then, in this case, too, the controller 80 changes the setting of the threshold value Dt by carrying out the process according to the flows of FIGS. 4, 6A and 6B when receiving the purge instruction signal giving the user's instruction for the intensive purge. However, in this modified embodiment, as described above, because the upper limit value J is constant regardless of the total discharge amount, after setting or changing the threshold value Dt to either the lower limit value in recording Ka or the duty Dp in the step S305, S403, S306 or S404, even if the total discharge amount increases, the threshold value Dt will not reach the upper limit value J. Therefore, in this modified embodiment, after the threshold value Dt is set in the step S305 or S306 and after the threshold value Dt is changed in the step S403 or S404, the process directly returns to the flow of FIG. 4 without starting the second threshold value changing process.

Note that in the above modified embodiment, both the upper limit value J and the lower limit value K are constant regardless of the total discharge amount. However, in the same manner as in the above embodiment, the lower limit value K may decrease as the total discharge amount increases in the above modified embodiment.

Further, if the upper limit value J of the threshold value Dt stored in the flash memory 84 decreases as the total discharge amount increases, then the lower limit value K of the threshold value Dt stored in the flash memory 84 may be constant regardless of the total discharge amount.

Further, in the above embodiment, the flash memory 84 stores the lower limit value K of the threshold value Dt. Then, when receiving the purge instruction signal giving the instruction for the intensive purge, if the duty Dp of the previous recording is smaller than the lower limit value in recording Ka for any of the nozzle rows 9, then the controller 80 sets or changes the threshold value Dt to the lower limit value in recording Ka (S305 or S403). Further, if the duty Dp of the previous recording for all nozzle rows 9 is not smaller than the lower limit value in recording Ka and equal to or smaller than the upper limit value in recording Ja, then the controller 80 sets or changes the threshold value Dt to the smallest duty Dp (S306 or S404). However, the present teaching is not limited to that.

For example, if the flash memory 84 may not store the lower limit value K of the threshold value Dt. Then, when receiving the purge instruction signal giving the instruction for the intensive purge and where the duty Dp is equal to or smaller than the upper limit value in recording Ja for any nozzle row 9 in the previous recording, then the threshold value Dt may be set or changed constantly to the aforementioned smallest duty Dp.

Further, in the above embodiment, on the occasion of receiving the purge instruction signal giving the user's instruction for the intensive purge, if the duty Dp for all nozzle rows 9 in the previous recording is neither larger than the upper limit value in recording Ja nor smaller than the lower limit value in recording Ka, then the controller 80 sets or changes the threshold value Dt to the smallest duty Dp (S306 or S404). However, the present teaching is not limited to that.

For example, on the occasion of receiving the purge instruction signal giving the instruction for the intensive purge, if the duty Dp for all nozzle rows 9 in the previous recording is neither larger than the upper limit value in recording Ja nor smaller than the lower limit value in recording Ka, then the threshold value Dt may be set or changed to a predetermined value which is smaller than the upper limit value in recording Ja but larger than the smallest duty Dp.

Further, in the above embodiment, with the threshold value Dt being not yet set, on the occasion of receiving the purge instruction signal giving the instruction for the intensive purge, if the duty Dp for all nozzle rows 9 in the previous recording is larger than the upper limit value in recording Ja (S302: Yes), then the controller 80 sets the threshold value Dt to the upper limit value J (S303). However, the present teaching is not limited to that.

In such a case as above, the threshold value Dt may be set to a smaller value than the upper limit value in recording Ja for example and, thereafter, until the threshold value Dt exceeds the upper limit value J, the value of the threshold value Dt may be maintained. Then, when the threshold value Dt reaches the upper limit value J because the upper limit value J decreases as the total discharge amount increases, the threshold value Dt may be set to the upper limit value J.

Further, in the above embodiment, with the threshold value Dt being not yet set, on the occasion of receiving the purge instruction signal giving the instruction for the intensive purge, the threshold value Dt is set and, thereafter, on receiving again the purge instruction signal giving the instruction for the intensive purge, the threshold value Dt is changed. However, without being limited to that, for example, with the threshold value Dt being not yet set, after the threshold value Dt is set on receiving the purge instruction signal giving the instruction for the intensive purge, the threshold value Dt may not be changed.

Further, in the printer 1 according to the above embodiment, the threshold value Dt is not set in the aforementioned initial state. However, without being limited to that, for example, the threshold value Dt may be set in the aforementioned initial state. In such case, for example, the controller 80 carries out the steps S203 to S205 when receiving the purge instruction signal giving the instruction for the intensive purge.

Further, in the above embodiment, on the occasion of receiving the purge instruction signal giving the instruction for the intensive purge, the threshold value Dt is set on the basis of the duty Dp in the previous recording. However, without being limited to that, for example, on the occasion of receiving the purge instruction signal giving the instruction for the intensive purge, the threshold value Dt may be set on the basis of the smallest duty Dp among the duties Dp in a plurality of successive recordings including the previous recording.

Further, in the above embodiment, the explanation was made with an example where the threshold value Dt is set on the basis of the duty in recording before receiving the purge instruction signal giving the instruction for the intensive purge. However, the present teaching is not limited to that.

For example, the printer may provide the nozzles with a function for detecting whether or not the inks have been discharged. Then, in this printer, when an ink cartridge is exchanged or whenever the total discharge amount increases by a predetermined amount or the like, a flushing process may be carried out for the ink jet head to discharge the inks from the plurality of nozzles with a predetermined duty. Then, after the flushing, whether or not the inks have been discharged may be detected and a signal indicating the detected result be set to the controller. Then, the controller may determine that the under refilling is happening if the signal shows that the detected result of whether or not the inks have been discharged satisfies a predetermined condition. Then, the threshold value Dt may set or changed in the same manner as explained in the above embodiment.

Here, the predetermined condition refers to, for example, such a condition that the above detected result shows no ink discharging from a predetermined number of nozzles 10 aligning successively and including the farthest nozzle 10 from the ink supply port of the ink jet head 4 among the plurality of nozzles 10 constituting any nozzle row 9. Alternatively, the predetermined condition is, for example, such that the above detected result shows that the ratio of the nozzles 10 of no ink discharging is larger than a predetermined ratio in any nozzle row 9. Note that in such case, the abovementioned flushing corresponds to the "discharging before receiving the signal".

Further, in the above embodiment, with the part of the discharging data corresponding to one recording path as the unit discharging data, based on whether or not the duty D on the one recording path indicated by the unit discharging data is less than the threshold value Dt, either the first recording path process or the second recording path process are carried out. However, without being limited to that, for example, with the part of the discharging data corresponding to two or more predetermined successive recording paths as the unit discharging data, based on whether or not an average value of the duties on the predetermined recording paths indicated by the unit discharging data is less than the threshold value Dt, either the first recording path process or the second recording path process may be carried out.

Further, in the above embodiment, by letting the ink discharge amount in one recording path be smaller in the second recording path process than in the first recording path process, so as to increase the number of recording paths carried out for the unit discharging data, the time taken for recording is elongated. However, the present teaching is not limited to that.

For example, by letting the moving speed of the carriage 2 for the recording path be slower in the second recording path process than in the first recording path process and, according to that, the ink discharging period may be elongated for the plurality of nozzles 10 to discharge the inks. In such a case, too, with the time for the recording path carried out in the first recording path process as a predetermined time, the time for the recording path carried out in the second recording path process is longer than that predetermined time.

Alternatively, the time for recording may be elongated by providing a standby time after the first recording path process and the second recording path process and letting the standby time be longer for the second recording path process than for the first recording path process. Note that in such case, the combination of one recording path carried out for the first recording path process and the standby time between that recording path and the next recording path corresponds to the "first discharging operation" of the present teaching. Further, the combination of one recording path carried out for the second recording path process and the standby time between that recording path and the next recording path corresponds to the "second discharging operation" of the present teaching. Then, with the time for the first discharging operation as a predetermined time, the time for the first discharging operation is longer than that predetermined time.

Further, in the above explanation, an example was taken to apply the present teaching to a printer provided with a so-called serial head which moves together with the cartridge in the scanning direction while discharging the inks from the plurality of nozzles. However, without being limited to that, it is also possible to apply the present teaching to a printer provided with a so-called line head where a plurality of nozzles are aligned in the scanning direction through the entire length of recording paper.

A printer provided with the line head carries out recording by conveying the recording paper in the conveyance direction while discharging the inks from the plurality of nozzles of the line head. Then, in this case, based on a unit discharging data indicating whether or not there is ink discharging from the plurality of nozzles within a predetermined time, if the discharge amount is less than a threshold value in the ink discharging, then the first discharging operation is carried out to discharge the inks from the plurality of nozzles of the line head with a predetermined discharging period. By virtue of this, it is possible to record the partial image corresponding to the unit discharging data in the above predetermined time.

Further, if the discharge amount is equal to or more than the threshold value in discharging the inks from the plurality of nozzles on the basis of the unit discharging data, then the second discharging operation is carried out to discharge the inks from the plurality of nozzles of the line head with a longer discharging period than the predetermined discharging period. By virtue of this, it is possible to record the partial image corresponding to the unit discharging data in a longer time than the above predetermined time.

Further, in the above explanation, an example was taken to apply the present teaching to an ink jet printer which carries out recording by discharging inks from nozzles. However, without being limited to that, it is also possible to apply the present teaching to liquid discharging apparatuses other than ink jet printers, discharging a liquid other than ink.

What is claimed is:

1. A liquid discharging apparatus comprising:

a liquid discharging head having a plurality of nozzles;

a tank configured to store liquid to be supplied to the liquid discharging head; and a controller, wherein the controller is configured to cause the liquid discharging head to perform a discharging operation for discharging the liquid from the nozzles base on a discharging data indicating whether the liquid is to be discharged from the nozzles, the discharging data including unit discharging data indicating whether the liquid is to be discharged from the nozzles within a predetermined time period, wherein in the discharging operation, a) under a condition that a discharge amount based on the unit discharging data is less than a threshold value, the controller is configured to cause the liquid discharging head to perform a first discharging operation to discharge the liquid from the nozzles during the predetermined time period based on the unit discharging data, and b) under a condition that the discharge amount based on the unit discharging data is equal to or more than the threshold value, the controller is configured to cause the liquid discharging head to perform a second discharging operation to discharge the liquid from the nozzles during another time period longer than the predetermined time period based on the unit discharging data, and wherein under a condition that the controller receives a signal for changing the threshold value, the controller is configured to lower the threshold value according to the discharge amount during the predetermined time period, which is included in a discharging period before the controller receives the signal.

2. The liquid discharging apparatus according to claim 1, further comprising a memory configured to store information of an upper limit value in the range of the threshold value, wherein under a condition that the controller receives the signal with the threshold value being set at the upper limit value, and that the discharge amount is less than the upper limit value during the predetermined time period, which is included in the discharging period before the controller receives the signal, the controller is configured to change the threshold value to a value less than the upper limit value according to the discharge amount during the predetermined time period included in the discharging period before the controller receives the signal.

3. The liquid discharging apparatus according to claim 2, wherein under a condition that the controller receives the signal with the threshold value being set at the upper limit value, and that the discharge amount is less than the upper limit value during the predetermined time period, which is included in the discharging period before the controller receives the signal, the controller is configured to change the threshold value to the discharge amount during the predetermined time period included in the discharging period before the controller receives the signal.

4. The liquid discharging apparatus according to claim 2, wherein the memory is configured to store information of a first upper limit value and information of a second upper limit value, the first upper limit value being the upper limit value in a state of an environmental temperature being a first temperature, the second upper limit value being the upper limit value in a state of the environmental temperature being a second temperature different from the first temperature, under a condition that the threshold value in the state of the environmental temperature being the first temperature is set at the first upper limit value, and that the controller receives the signal in the state of the environmental temperature being the first temperature, the controller is configured to:

let the first upper limit value in the discharging period before the controller receives the signal be a discharging-time first upper limit value; and let the second upper limit value in the discharging period be a discharging-time second upper limit value;

under a condition that the discharge amount during the predetermined time period included in the discharging period is less than the discharging-time first upper limit value, the controller is configured to:

change the threshold value in the state of the environmental temperature being the first temperature to a value less than the discharging-time first upper limit value according to the discharge amount during the predetermined time period included in the discharging period; and change the threshold value in the state of the environmental temperature being the second temperature based on the threshold value in the state of the environmental temperature being the first temperature and a difference between the discharging-time first upper limit value and the discharging-time second upper limit value.

5. The liquid discharging apparatus according to claim 2, wherein the information of the upper limit value indicates that the upper limit value is lowered as an accumulated value of the discharge amount of the liquid from the liquid discharging head increases, under a condition that the signal is received with the threshold value being set at the upper limit value, and that the discharge amount during the predetermined time period, which is included in the discharging period before the controller receives the signal, is less than the upper limit value, the controller is configured to:

change the threshold value to the predetermined value less than the upper limit value according to the discharge amount during the predetermined time period included in the discharging period;

thereafter, maintain the threshold value being set at the predetermined value, until the upper limit value reaches the predetermined value because the upper limit value is lowered as the accumulated value increases; and set the threshold value to the upper limit value after the upper limit value has reached the predetermined value because the upper limit value is lowered as the accumulated value increases.

6. The liquid discharging apparatus according to claim 1, further comprising a memory configured to store information of a lower limit value in the range of the threshold value, wherein under a condition that the controller receives the signal, and that the discharge amount during the predetermined time period included in the discharging period before the controller receives the signal is less than the lower limit value, the controller is configured to change the threshold value to the lower limit value.

7. The liquid discharging apparatus according to claim 6, wherein the memory is configured to further store information of an upper limit value in the range of the threshold value, the information of the upper limit value indicates that the upper limit value is lowered as an accumulated value of the discharge amount of the liquid from the liquid discharging head increases, under a condition that the controller receives the signal and that the discharge amount during the predetermined time period, which is included in the discharging period before the controller receives the signal, is less than the lower limit value, the controller is configured to:

set the threshold value to the lower limit value;

thereafter, maintain the threshold value being set at the lower limit value until the upper limit value reaches the lower limit value because the upper limit value is lowered as the accumulated value increases; and set the threshold value to the upper limit value after the upper limit value has reached the lower limit value because the upper limit value is lowered as the accumulated value increases.

8. A liquid discharging apparatus comprising:

a liquid discharging head having a plurality of nozzles;

a tank configured to store liquid to be supplied to the liquid discharging head; and a controller, wherein the controller is configured to cause the liquid discharging head to perform a discharging operation for discharging the liquid from the nozzles based on a discharging data indicating whether the liquid is to be discharged from the nozzles, the discharging data including unit discharging data indicating whether the liquid is to be discharged from the nozzles within a predetermined time period, wherein in the discharging operation, under a condition that a threshold value for a discharge amount based on the unit discharging data is not yet set, the controller is configured to cause the liquid discharging head to perform a first discharging operation to discharge the liquid from the nozzles based on the unit discharging data, regardless of the discharge amount based on the unit discharging data, under a condition that the controller receives a signal for setting the threshold value, the controller is configured to set the threshold value based on the discharge amount during the predetermined time period, which is included in the discharging period before the controller receives the signal, and in the discharging operation thereafter, a) under a condition that the discharge amount based on the unit discharging data is less than the threshold value, the controller is configured to cause the liquid discharging head to perform the first discharging operation, and b) under a condition that the discharge amount based on the unit discharging data is equal to or more than the threshold value, the controller is configured to cause the liquid discharging head to perform a second discharging operation to discharge the liquid from the nozzles during another time period longer than the predetermined time period based on the unit discharging data.

9. The liquid discharging apparatus according to claim 8, further comprising a memory configured to store an upper limit value in the range of the threshold value, wherein under a condition that the controller receives the signal, and that the discharge amount during the predetermined time period, which is included in the discharging period before the controller receives the signal, is more than the upper limit value, the controller is configured to set the threshold value to the upper limit value.

* * * * *